US007565713B2

(12) United States Patent
Standish

(10) Patent No.: US 7,565,713 B2
(45) Date of Patent: Jul. 28, 2009

(54) SCRUBBING SPRAY DEVICE

(76) Inventor: Edward B. Standish, 8904 150th Ave. KP N., Gig Harbor, WA (US) 98329

( * ) Notice: Subject to any disclaimer, the term of this patent is extended or adjusted under 35 U.S.C. 154(b) by 722 days.

(21) Appl. No.: 11/092,400

(22) Filed: Mar. 29, 2005

(65) Prior Publication Data

US 2006/0218732 A1 Oct. 5, 2006

(51) Int. Cl.
*A47L 21/02* (2006.01)

(52) U.S. Cl. ..... 15/24; 15/29

(58) Field of Classification Search ..... 15/23, 15/24, 28, 29; 239/526, 310, 318; 401/289, 401/195, 290
See application file for complete search history.

(56) References Cited

U.S. PATENT DOCUMENTS

| | | | | |
|---|---|---|---|---|
| 3,638,264 | A | 2/1972 | Walton | |
| 4,060,871 | A | 12/1977 | Bryerton | |
| 4,084,281 | A * | 4/1978 | Smith | 15/29 |
| 4,796,321 | A | 1/1989 | Lee | |
| 4,812,070 | A | 3/1989 | Marty | |
| 5,423,102 | A | 6/1995 | Madison | |
| 5,649,334 | A * | 7/1997 | Henriquez et al. | 15/29 |
| 5,701,625 | A | 12/1997 | Siman | |
| 5,891,329 | A * | 4/1999 | Massholder | 210/100 |
| 5,906,319 | A | 5/1999 | Crowl | |
| 5,909,754 | A * | 6/1999 | Oh | 15/29 |
| 5,960,503 | A | 10/1999 | Del Pozo Y Mattei | |
| 5,988,911 | A * | 11/1999 | Browne et al. | 401/42 |
| 5,988,912 | A * | 11/1999 | Chen | 401/42 |
| 6,000,626 | A | 12/1999 | Futo et al. | |
| 6,595,440 | B2 | 7/2003 | Moriarty et al. | |
| 6,595,712 | B2 * | 7/2003 | Sickler | 401/289 |
| 6,749,135 | B2 | 6/2004 | Groblebe et al. | |

* cited by examiner

*Primary Examiner*—Dung Van Nguyen
(74) *Attorney, Agent, or Firm*—Dale J. Ream

(57) ABSTRACT

A scrubbing spray device includes a housing coupled to a base by a flexible hose for transferring fluid from the base to the housing. The base is preferably coupled to a building's hot and cold water supply lines. A brush member removably attaches to one end of the housing. An outlet channel attaches to the housing for moving between first and second configurations and selectively discharging fluid contained in the housing. These two configurations give the user the option of spraying the fluid onto the brush member or directly onto the object being cleaned. A soap reservoir is in communication with the housing for selectively introducing a cleaning substance into the fluid contained in the housing. A motor and battery are included for rotating the brush member, and the base may include a battery charger for charging the battery.

13 Claims, 6 Drawing Sheets

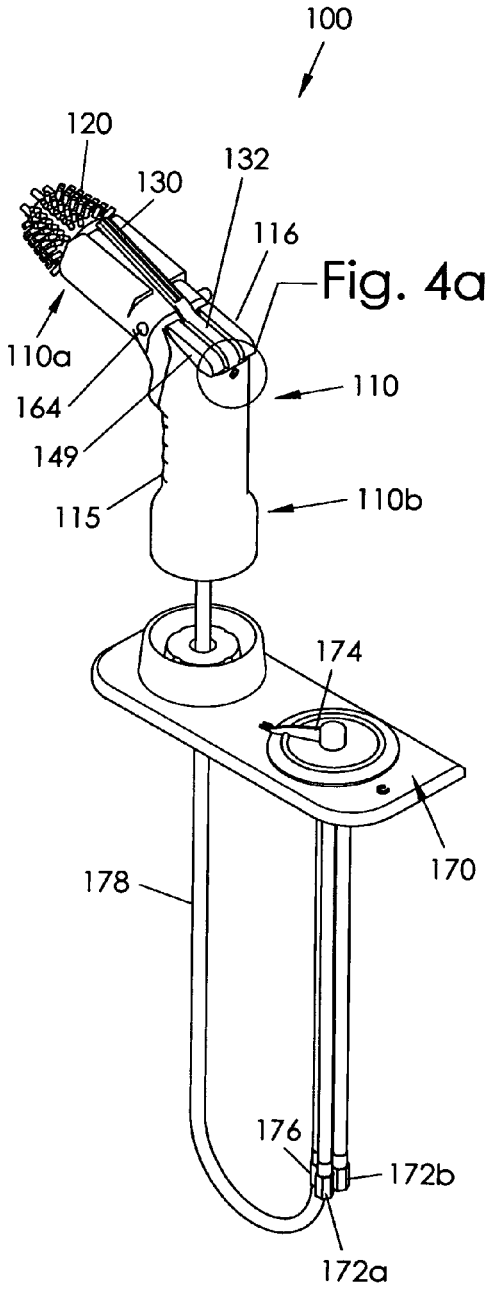
Fig. 4a
Fig. 1a
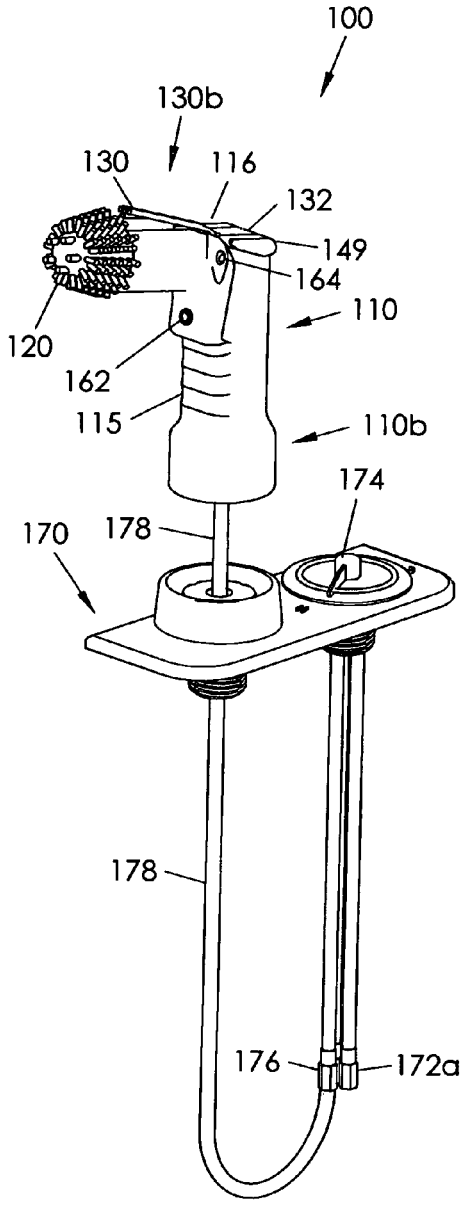
Fig. 1b

SCRUBBING SPRAY DEVICE

BACKGROUND AND SUMMARY OF THE INVENTION

This invention relates generally to a cleaning device. In particular, the present invention relates to a scrubbing spray device.

Washing dishes is currently one of the most dreaded and repetitive household tasks. Despite the increased use of dishwashing machines, many people continue to wash dishes by hand. Even for those with dishwashing machines, a large amount of pre-washing is often required.

In response to this, sprayers on sinks have become standard. Nevertheless, current sprayers suffer from multiple deficiencies. One such problem is the small force of the water acting on the caked-on food. Although wetting the food aids in its removal, the water spray is usually not of sufficient strength to dislodge it. Another problem is that the faucet valve must be on for the sprayer to be activated. This means that there is a large amount of wasted water between sprays.

Various proposals for improved sprayers and scrubbers are found in the art, such as in U.S. Pat. Nos. 3,638,264; 4,060,871; 4,796,321; 4,812,070; 5,423,102; 5,701,625; 5,906,319; 5,960,503; 6,000,626; 6,595,440; and 6,749,135. While assumably effective for their intended purposes, the existing devices do not provide a scrubbing spray device that has interchangeable rotating brush members, a positionable water spray, a refillable soap reservoir, a rechargeable battery, a base with a temperature selector and battery charger, and other features. Since these features ease the task of dish washing, it would be desirable to have a scrubbing spray device in which they are incorporated.

A scrubbing spray device according to the present invention includes a housing coupled to a base by a flexible hose for transferring fluid from the base to the housing. The base is preferably coupled to a building's hot and cold water supply lines. A brush member removably attaches to one end of the housing for cleaning various objects, such as dishes. An outlet channel pivotally attaches to the housing for moving between first and second configurations and selectively discharging fluid contained in the housing. These two configurations give the user the option of spraying the fluid contained in the housing onto the brush member or directly onto the object being cleaned. A soap reservoir is in communication with the housing for selectively introducing a cleaning substance into the fluid contained in the housing, and the soap reservoir may include a filling port for supplying a cleaning substance to the soap reservoir. A motor and battery are included for rotating the brush member either clockwise or counterclockwise, and the base may include a battery charger for charging the battery.

Therefore, a general object of this invention is to provide a scrubbing spray device that has interchangeable rotating brush members.

Another object of this invention is to provide a scrubbing spray device, as aforesaid, that has a positionable water spray.

Still another object of this invention is to provide a scrubbing spray device, as aforesaid, that has a refillable soap reservoir.

Yet another object of this invention is to provide a scrubbing spray device, as aforesaid, that has a rechargeable battery.

A further object of this invention is to provide a scrubbing spray device, as aforesaid, that has a base with a temperature selector and battery charger.

A still further object of this invention is to provide a scrubbing spray device, as aforesaid, that is portable and safe.

Other objects and advantages of this invention will become apparent from the following description taken in connection with the accompanying drawings, wherein is set forth by way of illustration and example, embodiments of this invention.

BRIEF DESCRIPTION OF THE DRAWINGS

FIG. 1*a* is a rear perspective view of a scrubbing spray device according to the current invention.

FIG. 1*b* is a front perspective view of the scrubbing spray device as in FIG. 1*a*.

DESCRIPTION OF THE PREFERRED EMBODIMENT

A scrubbing spray device according to the present invention will now be described in detail with reference to FIGS. 1*a* through 6*b* of the accompanying drawings. More particularly, a scrubbing spray device 100 includes a housing 110 and a brush member 120 (FIGS. 1*a* and 1*b*).

Figure 2A:
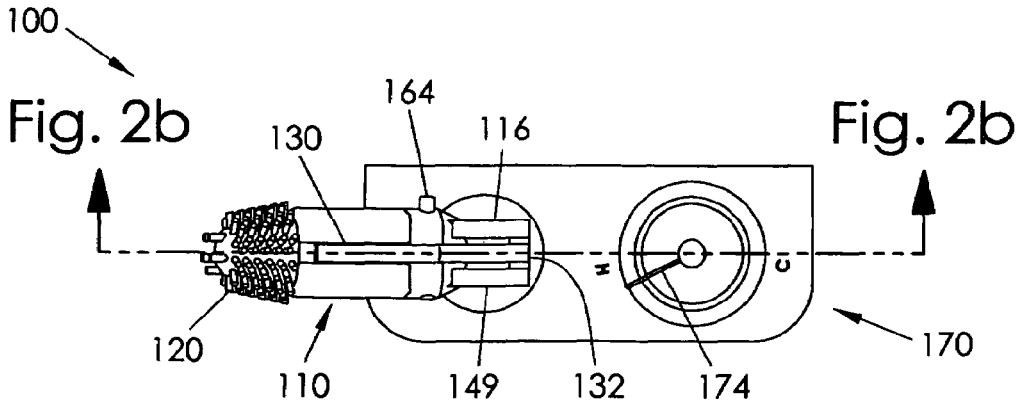
FIG. 2*a* is a top view of the scrubbing spray device as in FIG. 1*a*.
Figure 2B:
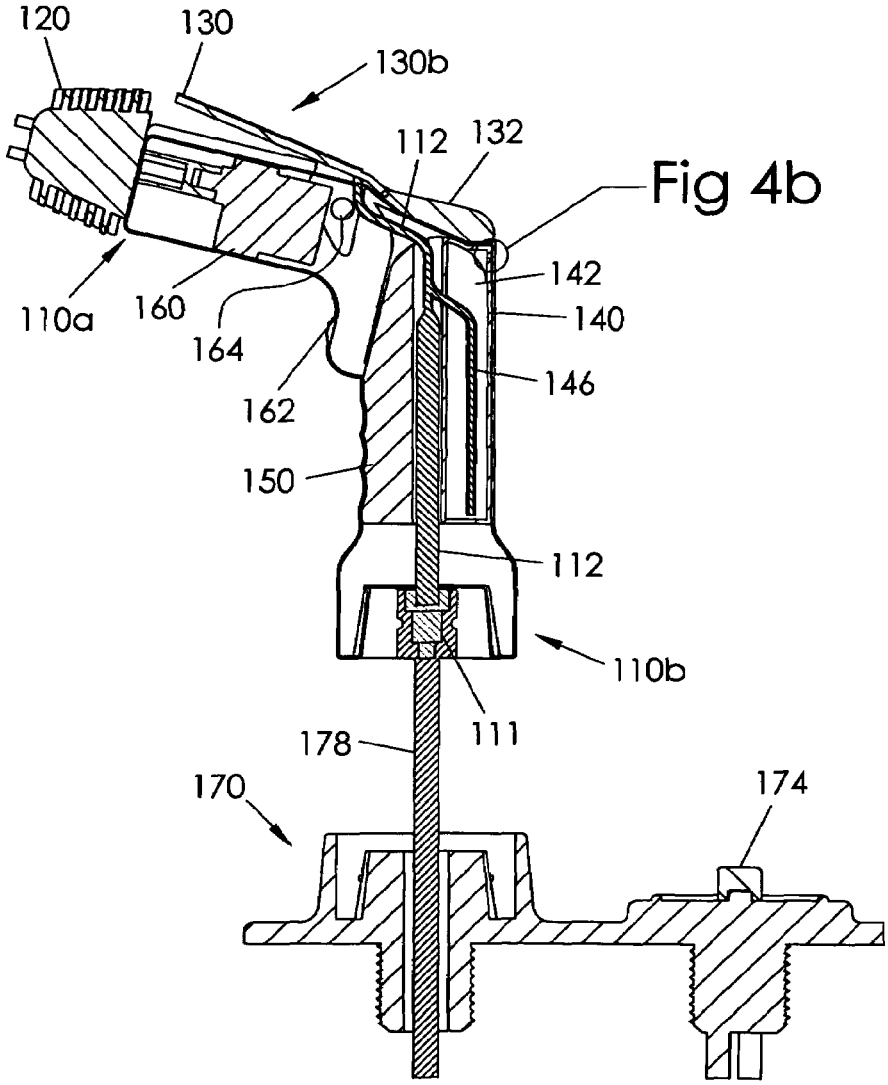
FIG. 2*b* is a sectional view taken along line 2*b*-2*b* of FIG. 2*a*.

The housing 110 has a cleaning end 110*a* and an inlet end 110*b* and defines a fluid duct 112 (FIG. 2*b*). An ergonomic handle 115 is preferably defined by the housing 110 adjacent the housing inlet end 110*b* (FIG. 1*b*). The housing 110 has a hose connection 111 at the inlet end 110*b* for supplying a fluid into the fluid duct 112 (FIG. 2*b*). The hose connection 111 is preferably a quick coupler for convenience and mobility, though other couplers could be used.

The brush member 120 is attached to the cleaning end 110*a* of the housing 110 (FIG. 2*b*). While the brush member 120 is preferably removably attached to the housing 110, it may be fixedly attached instead. If removable, a plurality of brush members 120 having different configurations may be included, and the appropriate brush member 120 may be attached to the housing 110 for a respective task.

Figure 3:
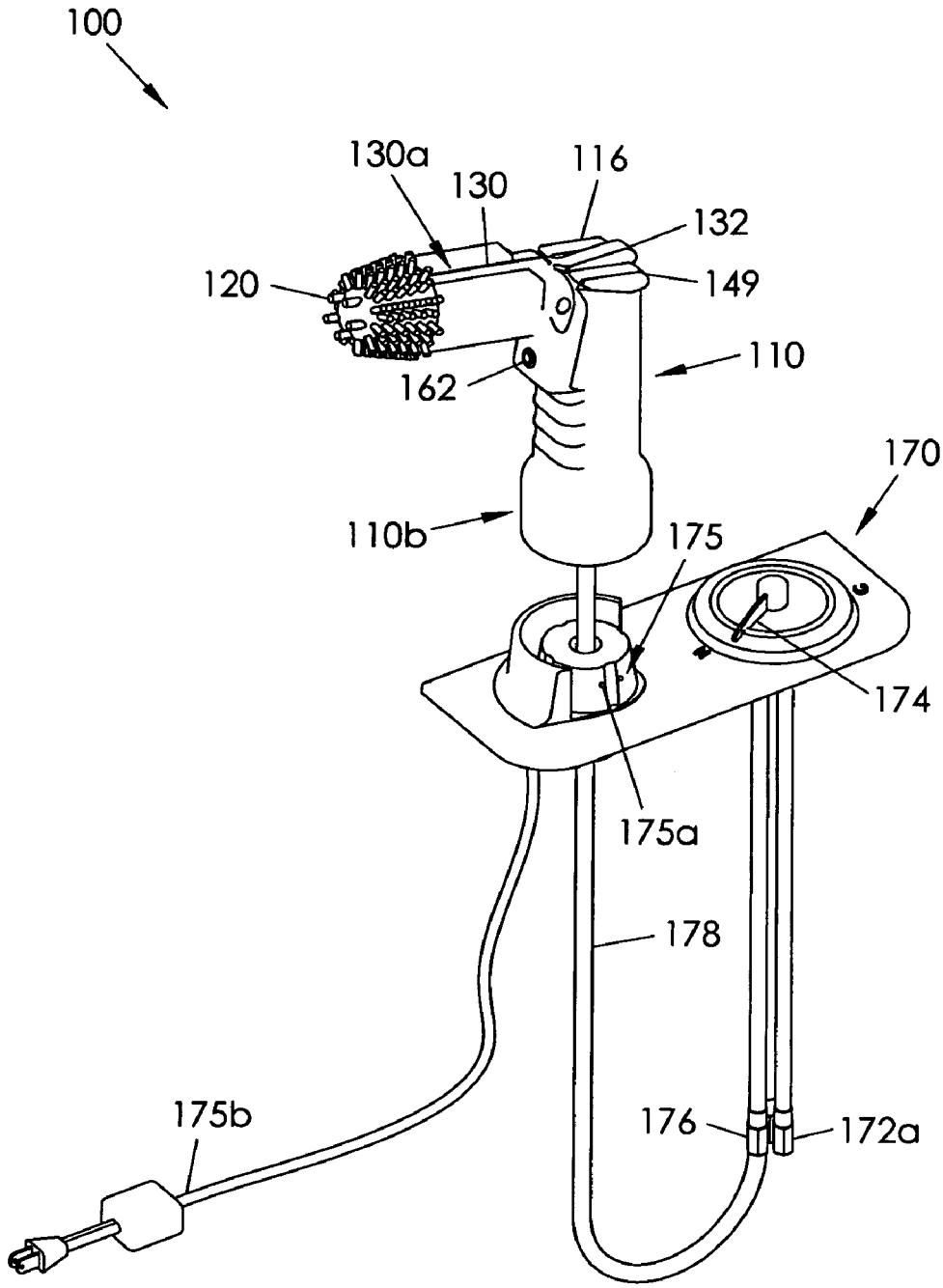
FIG. 3 is a perspective view of the scrubbing spray device as in FIG. 1*a* with a battery charger included in the base.

A fluid delivery outlet channel 130 having an open free end is attached to the housing 110 for moving between first and second configurations 130*a*, 130*b* and selectively discharging the fluid contained in the housing fluid duct 112. When the outlet channel 130 is at the first configuration 130*a*, the outlet channel 130 is pointed at the brush member 120 (FIG. 3). When the outlet channel 130 is at the second configuration 130*b*, the outlet channel 130 is pointed away from the brush member 120 (FIG. 2*b*). A direction selection member 132 is attached to the outlet channel 130 for selectively causing the outlet channel 130 to move between the first and second configurations 130*a*, 130*b*. While the outlet channel 130 is preferably pivotally attached to the housing 110 to allow the outlet channel 130 to move between the first and second configurations 130*a*, 130*b*, other attachment methods may be used.

Figure 6A:
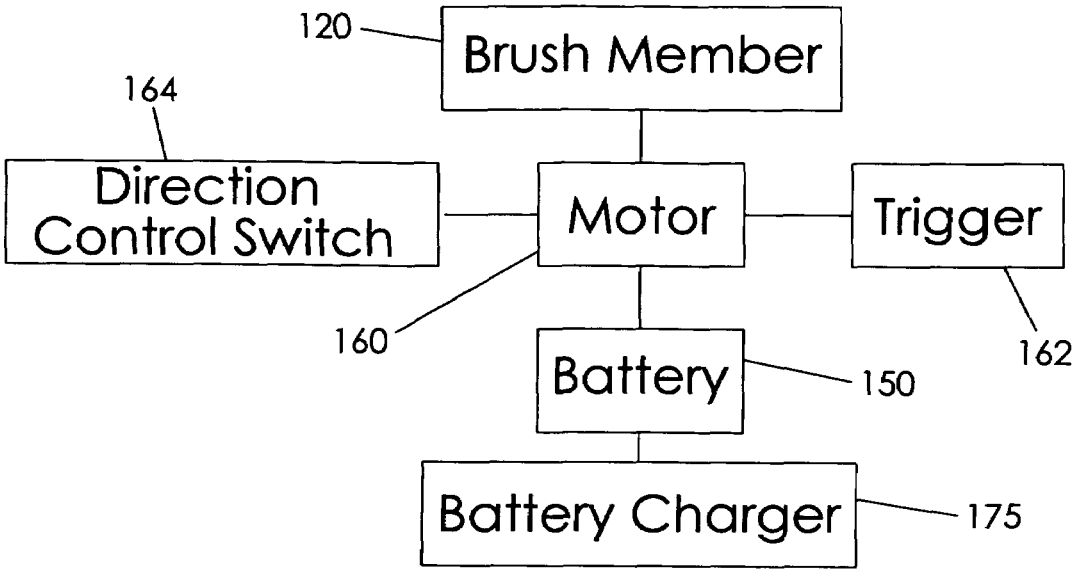
FIG. 6*a* is a block diagram of electrical components of the scrubbing spray device as in FIG. 3.
Figure 6B:
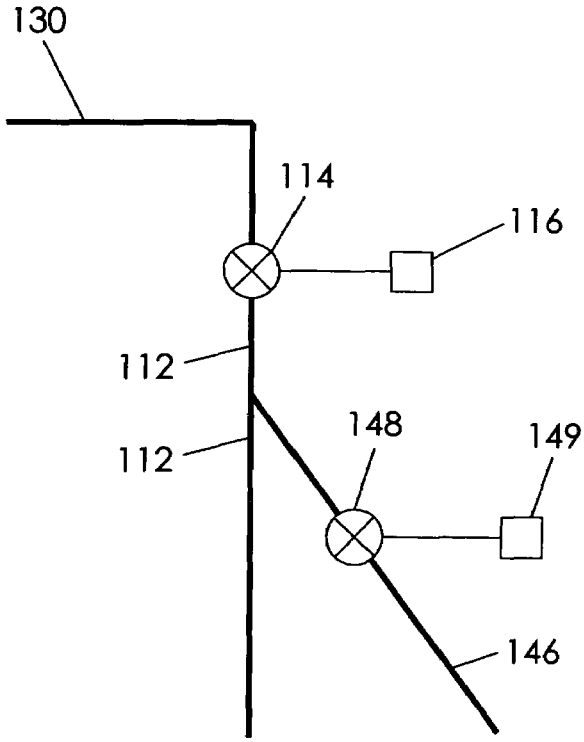
FIG. 6*b* is a schematic of part of the fluid system of the scrubbing spray device as in FIG. 1*a*.

A fluid valve 114 is positioned in the housing fluid duct 112 for controlling the movement of the fluid, and a fluid switch 116 is operatively connected to the fluid valve 114 for selectively manipulating the fluid valve 114 (FIG. 6*b*). By manipulating the fluid valve 114, the fluid in the housing fluid duct 112 may be allowed to exit through the outlet channel 130.

Figure 4A:
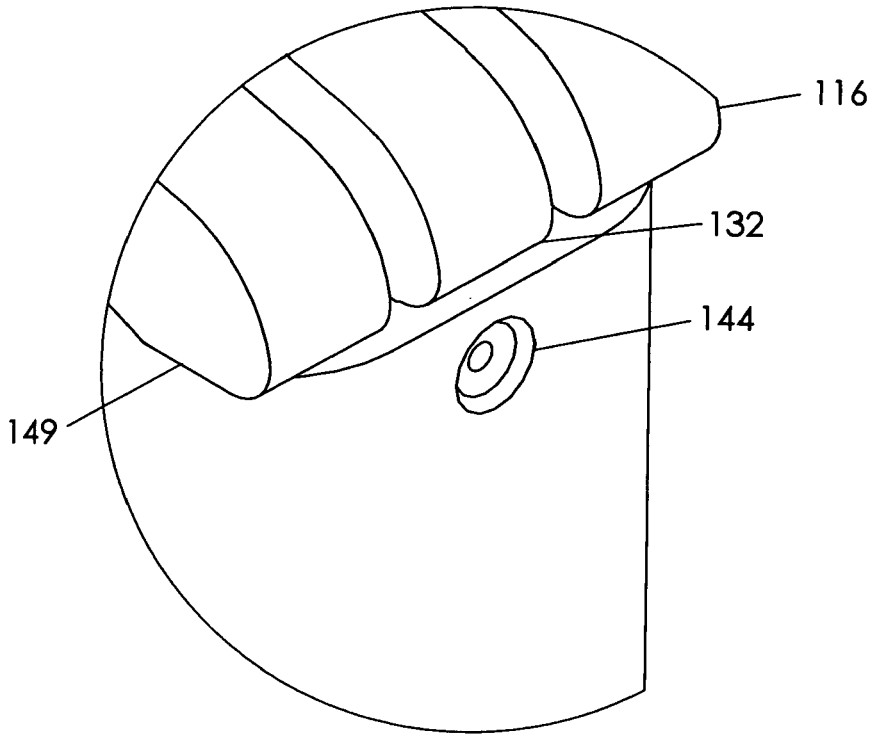
FIG. 4*a* is a perspective view on an enlarged scale taken from FIG. 1*a*.
Figure 4B:
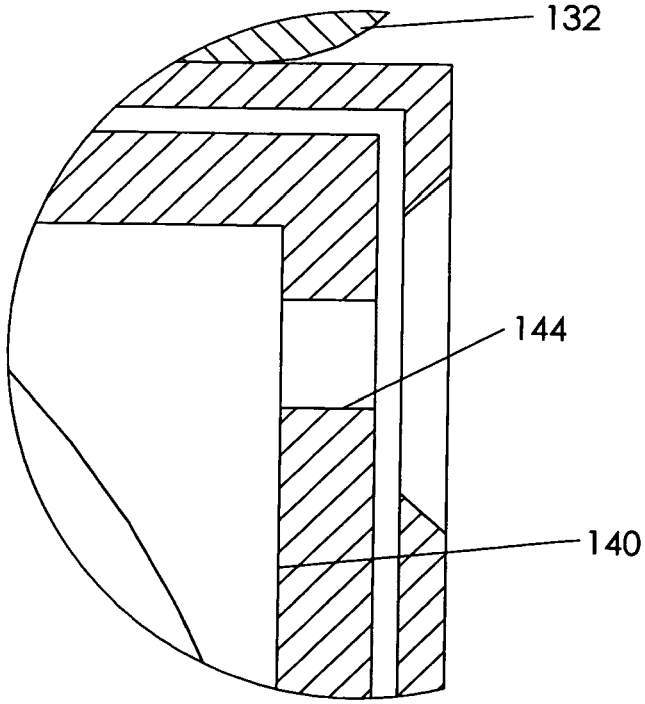
FIG. 4*b* is a sectional view on an enlarged scale taken from FIG. 2*b*.

A soap reservoir 140 is positioned in the housing 110 in communication with the housing fluid duct 112, and a cleaning substance 142 may be contained in the soap reservoir 140 (FIG. 2*b*). The soap reservoir 140 preferably includes a filling port 144 for supplying the cleaning substance 142 into the soap reservoir 140 (FIGS. 4*a* and 4*b*). A soap reservoir outlet tube 146 connects the soap reservoir 140 to the housing fluid duct 112. The soap reservoir outlet tube 146 includes a soap valve 148, and a soap switch 149 is operatively connected to the soap valve 148 for selectively manipulating the soap valve 148 (FIG. 6*b*). By manipulating the soap valve 148, the soap reservoir outlet tube 146 may be opened and the cleaning substance 142 may be allowed to exit the soap reservoir 140 through the outlet tube 146 and mix with the fluid in the housing fluid duct 112.

A battery 150 is positioned in the housing 110, and a motor 160 is electrically connected to the battery 150 and operatively attached to the brush member 120 for selectively rotating the brush member 120 (FIGS. 2*b* and 6*a*). A trigger 162 is electrically connected to the motor 160 for selectively actuating the motor 160, whereby rotating the brush member 120. A direction control switch 164 may be operatively connected to the motor 160 for selectively changing the rotation direction of the brush member 120.

A base 170 may be included remote from the housing 110 (FIGS. 1*a* and 1*b*). The base 170 preferably has a configuration complementary to a configuration of the housing inlet end 110*b* for allowing the base 170 to support the housing 110 in an upright configuration (FIG. 2*b*). The base 170 preferably includes a hot water input 172*a* and a cold water input 172*b* for supplying hot water from a building's hot water supply line and cold water from a building's plumbing system, respectfully, into the base 170. The hot water input 172*a* may of course supply water directly from a hot water heater into the base 170. A temperature selection member 174 is preferably coupled to the hot water input 172*a* and the cold water input 172*b* for selectively allowing the hot water to enter the hot water input 172*a* and selectively allowing the cold water to enter the cold water input 172*b*. The base 170 includes a base outlet 176 for discharging the hot and cold water from the base 170, and a flexible hose 178 connects the base outlet 176 to the hose connection 111.

A battery charger 175 may be positioned in the base 170, and the battery 150 may be a rechargeable battery that is positioned in the housing 110 for interacting with the battery charger 175 when the housing 110 is supported on the base 170 (FIG. 3). The battery charger 175 includes a charging element 175*a* and a power cord 175*b* for electrically connecting the charging element 175*a* to a power source, such as the building's electrical system.

In use, the base hot water input 172*a* may be coupled to the building's hot water supply line and the base cold water input 172*b* may be coupled to the building's cold water supply line. The power cord 175*b* of the battery charger 175 may be electrically connected to the building's electrical system. One end of the flexible hose 178 connects to the base outlet 176, and the other end of the flexible hose 178 connects to the housing hose connection 111. The housing 110 may then be removably coupled to the base 170 in an upright configuration, with the housing inlet end 110*b* being received by the base 170. While the housing 110 is coupled to the base 170, the battery 150 may be recharged through interacting with the battery charger 175. The temperature selection member 174 may be adjusted to allow a desired amount of hot and cold water to enter the base 170 through the hot and cold water inputs 172*a*, 172*b*, respectfully. This hot and cold water mixes in the base 170, reaching a resulting temperature, and proceeds through the base outlet 176, the flexible hose 178, the housing hose connection 111, and into the housing fluid duct 112. It should be appreciated that if the base 170 were not included, the flexible hose 178 could connect the housing hose connection 111 to a water faucet or other pressurized water source.

A user may hold the housing 110 by the ergonomic handle 115 with the cleaning end 110*a* facing the item to be cleaned. To spray water, the user presses the fluid switch 116. The pressing of the fluid switch 116 manipulates the fluid valve 114, allowing the fluid in the housing fluid duct 112 to exit through the outlet channel 130 (FIG. 6*b*).

Very importantly, the user may move the outlet channel 130 between the first and second configurations 130*a*, 130*b* using the direction selection member 132; by pressing the direction selection member 132, the outlet channel 130 pivots about the housing 110. This gives the user the option of spraying the water onto the brush member 120 or directly onto the object being cleaned. As there are times when each spray characteristic would be beneficial, it is clearly advantageous to provide the user with both to choose from.

To spray soapy water, the user presses the soap switch 149 as well as the fluid switch 116 as described above. Pressing the soap switch 149 manipulates the soap valve 148, allowing the cleaning substance 142 in the soap reservoir 140 to be drawn through the outlet tube 146 and mix with the water in the fluid duct 112 (FIG. 6*b*). The soap reservoir 140 may be refilled with cleaning substance 142 through the filling port 144 (FIGS. 4*a* and 4*b*).

To cause the brush member 120 to rotate, the user presses the trigger 162. Pressing the trigger 162 actuates the motor 160, causing the attached brush member 120 to rotate. The motor 160 is energized by the battery 150. The user may change the rotation direction of the brush member 120 by pressing the direction control switch 164. The rotation direction of the brush member 120 may be controlled by gearing or by choosing the rotation direction of the motor 160, among other ways.

Figure 5:
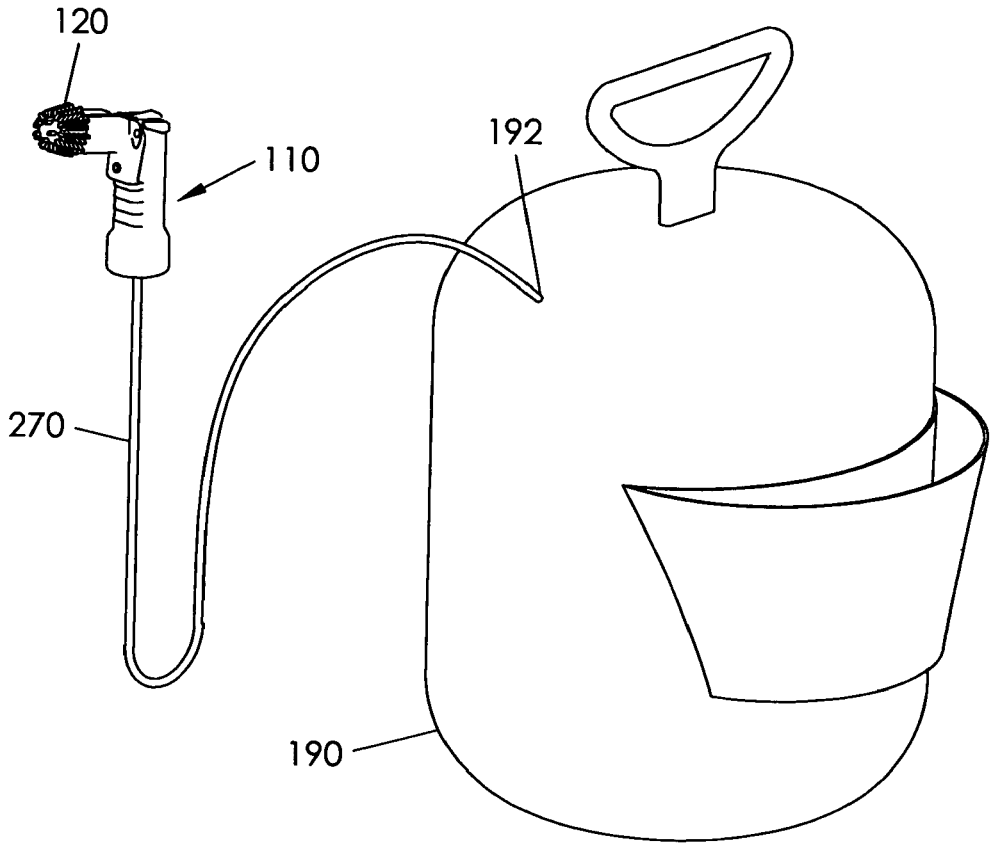
FIG. 5 is a perspective view of the scrubbing spray device as in FIG. 1*a* with a pressurized tank and without the base.

A scrubbing spray device according to another embodiment of the present invention is shown in FIG. 5 and includes a construction substantially similar to the construction previously described except as specifically noted below. More particularly, the scrubbing spray device includes a pressurized tank 190 remote from the housing 110. The pressurized tank 190 has a tank outlet 192 for discharging a fluid contained in the pressurized tank. A flexible hose 270 may be attached to the tank outlet 192.

In use, the housing 110 may be disconnected at the hose connection 111 from the flexible hose 178 attached to the base 170. The housing 110 may then be attached at the hose connection 111 to a free end of the flexible hose 270. This allows the scrubbing spray device 100 to clean objects that are remote from the base 170.

It is understood that while certain forms of this invention have been illustrated and described, it is not limited thereto except insofar as such limitations are included in the following claims and allowable functional equivalents thereof.

What is claimed is:

1. A scrubbing spray device, comprising:

a housing having an inlet end and a cleaning end and defining a fluid duct, said housing having a hose connection at said inlet end for supplying a fluid into said fluid duct;

a brush member removably and rotatably attached to said cleaning end of said housing such that said brush member is interchangeable with another brush member;

an outlet channel pivotally attached to said housing and selectively movable between first and second configurations for selectively discharging the fluid contained in said housing fluid duct in different directions;

wherein said outlet channel is pointed at said brush member at said first configuration and said outlet channel is pointed away from said brush member at said second configuration;

a direction selection member attached to said outlet channel for selectively causing said outlet channel to move between said first and second configurations;

a battery positioned in said housing;

a motor electrically connected to said battery and operatively attached to said brush member for selectively rotating said brush member; and a trigger electrically connected to said motor for selectively actuating said motor to rotate said brush member; and a direction control switch operatively connected to said motor for selectively changing the rotation direction of said brush member.

2. The scrubbing spray device as in claim 1, further comprising a soap reservoir positioned in said housing in communication with said housing fluid duct for containing a cleaning substance.

3. The scrubbing spray device as in claim 2, wherein said soap reservoir includes a filling port for supplying the cleaning substance into said soap reservoir.

4. The scrubbing spray device as in claim 2, further comprising a soap switch operatively connected to said soap reservoir for selectively allowing the cleaning substance to exit said soap reservoir and mix with the fluid in said housing fluid duct.

5. The scrubbing spray device as in claim 2, wherein:

said soap reservoir includes a soap reservoir outlet tube;

said soap reservoir outlet tube includes a soap valve for selectively opening said soap reservoir outlet tube; and a soap switch is operatively connected to said soap valve for selectively manipulating said soap valve for allowing the cleaning substance to exit said soap reservoir and mix with the fluid in said housing fluid duct.

6. The scrubbing spray device as in claim 1, further comprising:

a fluid valve in said housing fluid duct for controlling the movement of the fluid; and a fluid switch operatively connected to said fluid valve for selectively manipulating said fluid valve for allowing the fluid in said housing fluid duct to exit through said outlet channel.

7. The scrubbing spray device as in claim 1, wherein said hose connection is a quick coupler; said scrubbing spray device further comprising:

a pressurized tank remote from said housing and having a tank outlet for discharging a fluid contained in said pressurized tank; and a flexible hose for connecting said housing quick coupler to said tank outlet.

8. The scrubbing spray device as in claim 1, further comprising a base remote from said housing, said base having a configuration complementary to a configuration of said housing inlet end for allowing said base to support said housing in an upright configuration.

9. The scrubbing spray device as in claim 8, further comprising:

a battery charger positioned in said base;

a rechargeable battery positioned in said housing for interacting with said battery charger when said housing is supported on said base.

10. The scrubbing spray device as in claim 8, wherein:

said base includes a hot water input for supplying hot water from a building's hot water heater into said base;

said base includes a cold water input for supplying cold water from a building's plumbing system into said base;

said base includes a temperature selection member coupled to said hot water input and said cold water input for selectively allowing said hot water to enter said hot water input and selectively allowing said cold water to enter said cold water input;

said base includes a base outlet for discharging said hot and cold water from said base; and a flexible hose connects said base outlet to said hose connection of said housing.

11. A scrubbing spray device for attachment to a building's hot and cold water supply lines, said device comprising:

a housing having a cleaning end and an inlet end and defining a fluid duct;

a hose connection at said housing inlet end for supplying a fluid into said housing fluid duct;

a brush member rotatably attached to said housing cleaning end;

an outlet channel pivotally attached to said housing for selectively discharging the fluid contained in said housing fluid duct, said outlet channel being movable between a first configuration in which said outlet channel is pointed at said brush member and a second configuration in which said outlet channel is pointed away from said brush member;

a direction selection member attached to said outer channel and configured to selectively move said outer channel between said first and second configurations;

a base remote from said housing, said base having a configuration complementary to a configuration of said housing inlet end for allowing said base to support said housing in an upright configuration, said base comprising:

a hot water input for supplying hot water from the hot water supply line into said base;

a cold water input for supplying cold water from the cold water supply line into said base;

a temperature selection member coupled to said hot water input and said cold water input for selectively allowing the hot water to enter said hot water input and selectively allowing the cold water to enter said cold water input;

a base outlet for discharging the hot and cold water from said base;

a flexible hose connecting said base outlet to said housing hose connection;

a battery charger positioned in said base;

a rechargeable battery positioned in said housing for interacting with said battery charger when said housing is supported on said base;

a motor electrically connected to said battery and operatively attached to said brush member for selectively rotating said brush member;

a trigger electrically connected to said motor for selectively actuating said motor to rotate said brush member; and a direction control switch coupled to said motor for selectively changing the rotation direction of said brush member.

12. The scrubbing spray device as in claim 11, further comprising:

a fluid valve in said housing fluid duct for controlling the movement of the fluid; and a fluid switch coupled to said fluid valve for selectively manipulating said fluid valve for allowing the fluid in said housing fluid duct to exit through said outlet channel.

13. The scrubbing spray device as in claim 11, further comprising:

a soap reservoir in communication with said housing fluid duct for containing a cleaning substance, said soap reservoir including a soap reservoir outlet tube;

a soap valve coupled to said soap reservoir outlet tube for selectively opening said soap reservoir outlet tube; and a soap switch coupled to said soap valve for selectively manipulating said soap valve for allowing the cleaning substance to exit said soap reservoir through said soap reservoir outlet tube and mix with the fluid in said housing fluid duct.

* * * * *